US008777236B2

(12) United States Patent
Bellehumeur et al.

(10) Patent No.: US 8,777,236 B2
(45) Date of Patent: Jul. 15, 2014

(54) SKATE BRAKING SYSTEM

(71) Applicant: Alexander Bellehumeur, Trustee of the Alex Bellehumeur Family Trust, Long Beach, CA (US)

(72) Inventors: Alexander R. Bellehumeur, Long Beach, CA (US); James Woods, Tustin, CA (US)

(73) Assignee: Alexander Bellehumeur, Long Beach, CA (US), Trustee of the Alex Bellemumeur Family Trust ( * ) Notice: Subject to any disclaimer, the term of this patent is extended or adjusted under 35 U.S.C. 154(b) by 0 days.

(21) Appl. No.: 13/624,680

(22) Filed: Sep. 21, 2012

(65) Prior Publication Data

US 2013/0075987 A1 Mar. 28, 2013

Related U.S. Application Data

(60) Provisional application No. 61/538,595, filed on Sep. 23, 2011.

(51) Int. Cl.
*A63C 17/14* (2006.01)

(52) U.S. Cl.
USPC ..... 280/11.217; 280/11.204; 280/11.211; 280/11.214; 280/11.215; 280/11.221; 280/11.224

(58) Field of Classification Search
USPC ..... 280/11.204, 11.211, 11.214, 11.215, 280/11.217, 11.221, 11.224; 188/68, 71.2, 188/71.5, 74, 369, 71.1, 71.4
See application file for complete search history.

(56) References Cited

U.S. PATENT DOCUMENTS

| | | | | |
|---|---|---|---|---|
| 5,639,104 | A * | 6/1997 | Haldemann | 280/11.207 |
| 5,924,704 | A * | 7/1999 | Johnson | 280/11.211 |
| 5,938,213 | A * | 8/1999 | Gignoux | 280/11.211 |
| 7,264,091 | B2 | 9/2007 | Bellehumeur et al. | |
| 7,455,305 | B2 | 11/2008 | Bellehumeur et al. | |
| 2007/0132201 | A1 * | 6/2007 | Bellehumeur et al. | 280/87.041 |

* cited by examiner

*Primary Examiner* — Hau Phan
*Assistant Examiner* — Bryan Evans
(74) *Attorney, Agent, or Firm* — Fulwider Patton LLP

(57) ABSTRACT

An improved braking system is disclosed in which a pair of conical braking members engage a pair of skate wheels through vertical movement of a pushrod that is actuated by movement of the skater's foot within a cuff. The braking members are separated by a spring disposed on an axel to maintain the braking members in optimal braking position. The braking members are serrated to promote frictional contact with the wheels, and a disk is positioned on the axel to act as a clutch to control the braking force.

10 Claims, 9 Drawing Sheets

SKATE BRAKING SYSTEM

CROSS-REFERENCES TO RELATED APPLICATIONS

This application claims priority from U.S. Provisional Application No. 61/538,595, filed Sep. 23, 2011 incorporated by reference in its entirety.

BACKGROUND

The popularity of roller skating has continued to grow in this country, and it is estimated by the Roller Skating Association that more than forty million Americans engage in roller skating. Roller skating safety is a paramount concern to both participants and skate providers. Roller skating injuries, while statistically lower and less significant than many team oriented sports like basketball and soccer, still occur at a fairly high frequency. Roughly 3 participants in a thousand will injure themselves to the extent that hospitalization is required. Moreover, many of the injured skaters are experience skaters. Below is a table of injuries sustained by inline roller skaters.

CHARACTERISTICS OF FALLS AND INJURIES SUSTAINED BY INLINE SKATERS

| Characteristic | % of Sample |
|---|---|
| **Location of Fall** | |
| Sidewalk or driveway | 26 |
| Street | 22 |
| Park or bike path | 19 |
| Indoors | 10 |
| Parking lot | 9 |
| Other | 14 |
| **Proximate Cause of Fall** | |
| Spontaneous loss of balance | 41 |
| Striking a stationary hazard [1] | 40 |
| Striking a moving object [2] | 11 |
| Swerving to avoid hazard or collision | 4 |
| Other | 4 |
| **Special Factors Pertaining to Fall [3]** | |
| Hazardous Road Condition | |
| Cited | 53 |
| Cited as key cause | 63 |
| Skating out of control | |
| Cited | 25 |
| Cited as key cause | 67 |
| Poor visibility (twilight or darkness) | |
| Cited | 17 |
| Cited as key cause | 6 |
| Fatigue | |
| Cited | 11 |
| Cited as key cause | 37 |
| **Anatomical Site of Primary Injury [4]** | |
| Wrist | 32 |
| Lower leg (including ankle) | 13 |
| Face (or chin) | 12 |
| Elbow | 9 |
| Knee | 6 |
| Head | 5 |
| Other | 23 |
| **Type of Injury** | |
| Wrist fracture | 25 |
| Face or chin laceration | 10 |

-continued

CHARACTERISTICS OF FALLS AND INJURIES SUSTAINED BY INLINE SKATERS

| Characteristic | % of Sample |
|---|---|
| Wrist sprain | 6 |
| Elbow fracture | 5 |
| Lower-leg fracture | 5 |
| Ankle sprain | 4 |
| **Severity of Injury** | |
| Major | 51 |
| Minor | 49 |
| **Safety Gear Worn at Time of Injury** | |
| Wrist guards | 33 |
| Elbow pads | 28 |
| Knee pads | 45 |
| Helmet | 20 |
| All of the above gear | 7 |
| No gear | 46 |

The percentages are calculated for an estimated 6,331 persons treated in emergency departments nationally during the study period. They are based on data from 161 injured skaters, weighted according to the hospital in the NEISS sample in which they were treated.

As the statistics show, the cause of the injuries in many cases come from loss of balance or impact with a stationary object. Both of these conditions are related to a skater's speed, and the ability to brake safety when a hazardous situation arises. For that reason, there has been much work and research into safer braking systems, particularly for inline skates. Specifically, in most skate brakes, the skater must lift three wheels off the ground to make contact with a rear stopper on the back of the skate boot, causing instability in the skater.

U.S. Pat. No. 7,455,305 to Bellehumeur is directed to a skate brake particularly suited for an inline skate includes a braking carriage formed of left and right plates spaced apart by axles that support rollers thereon. The rollers engage the wheels of the skate when the carriage is maneuvered to the appropriate elevation, and the momentum of the wheels is arrested as a result of a frictional bearing of the rollers against the carriage surface. The carriage is raised and lowed by a rocker mounted below the skate and coupled to the carriage plates, where rotation of the rocker drives the plates and the carriage downward such that the rollers contact one or more wheels. The rocker is actuated by a linkage that includes a pushrod and a second rocker that is mounted to the skate boot, allowing the user to control the braking carriage by applying pressure to a rear location of the boot.

U.S. Pat. No. 7,264,091 to Bellehumeur is directed to a brake assembly for inline skates having a boot portion with right and left downwardly directed frame members. The frame members support at least three axles. Right and left carrier plates are positioned along an inner face of the downwardly directed frame members. At least two diabolos are supported by the right and left carrier plates. The diabolos each contact two wheels and are forced outwardly to provide a friction rubbing action against the carrier plates when the carrier plates have moved from a disengaged position to an engaged position.

While the skate brake art has shown advances over earlier braking systems, there is a constant striving to improve the overall effectiveness of the skate brake while minimizing wear on the brakes that result in premature replacement of wheels or other skate components. The present invention is directed to the goal of overall skate brake improvement.

SUMMARY OF THE INVENTION

The present invention is an improved skate brake particularly suited for an inline skate, wherein braking can be actuated while all four wheels are engaged with the ground. The system maintains superior control by keeping all four wheels on the ground, as opposed to a traditional rubber stopper which requires lifting the toe of the boot.

Another improvement in the present system is the ability to apply full braking force to the brake pad and frame plates, as opposed to applying the braking force directly to the wheels. The wheels are the trigger in activating the braking power. The braking system prevents slippage of the braking pad on the wheels, and resists "lockup" that could otherwise cause a skater to lose balance and also promotes flattening of that portion of the wheels touching the ground, leading to premature wear.

Braking power is activated by a downward application of force on an axel supporting the brake cones, which in turn forces the cones outward against the frame plates. This, in turn, causes the brake pad to be pressed against the frame plates to provide the friction needed to brake the skate. Braking cones may be serrated, but other forms of cone surface to provide friction, could be substituted.

If the wheel material is of a relatively soft material, no braking cone may be necessary, and the exact structure of the brake pad and brake cone could be constructed entirely of braking material, preventing slippage from occurring on the wheels.

These and other features of the invention will be understood in conjunction with the following description and associated drawings.

DETAILED DESCRIPTION OF THE PREFERRED EMBODIMENTS

Figure 1:
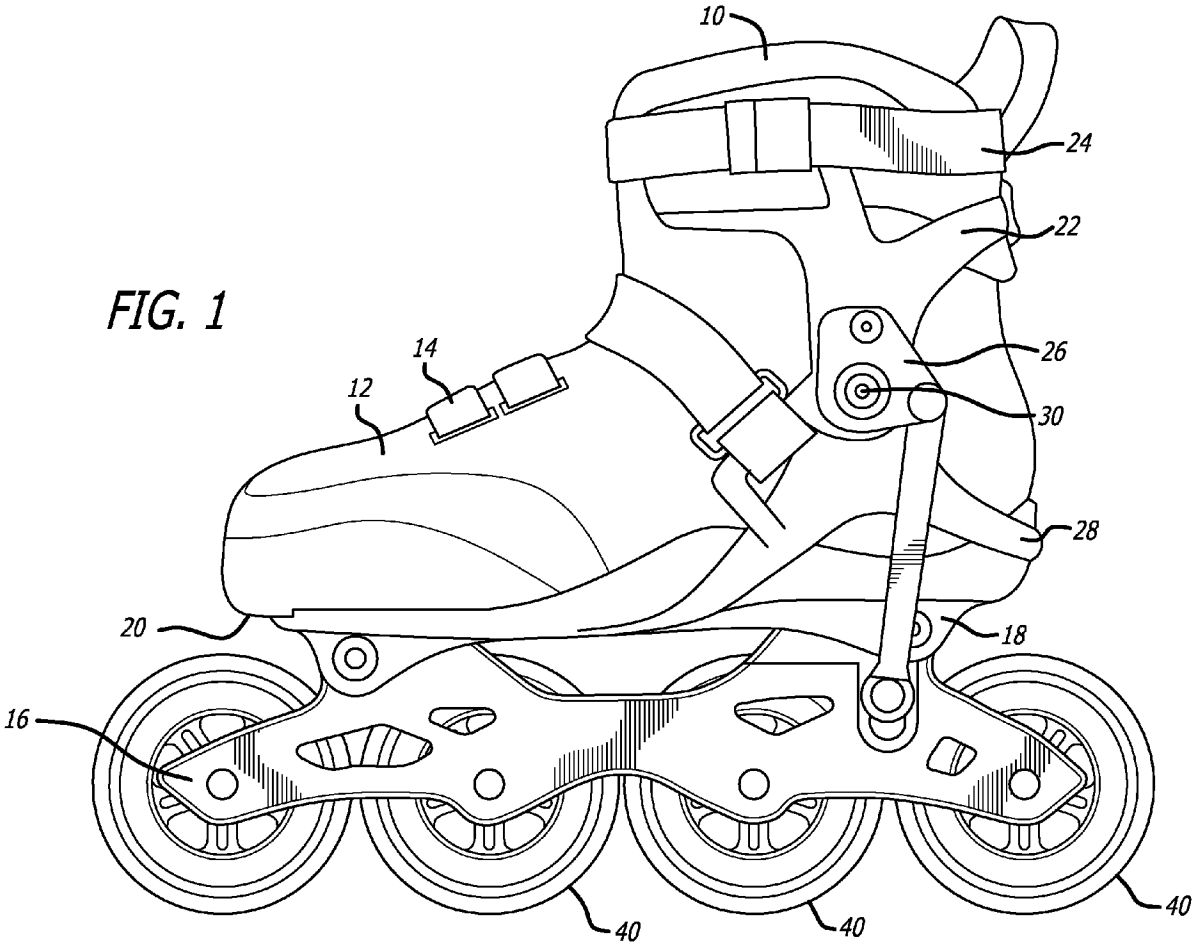
FIG. 1 is a side view of a roller skate with the improved braking system.

FIG. 1 illustrates the improved braking system of the present invention as it is applied to a traditional inline skate. The skate 10 has a boot 12 that receives the skater's foot, and fastening means 14 to secure the skate to the user. A skate frame 16 may be secured to the boot 12 by plates 18 that are formed or fastened to the bottom 20 of the boot 12.

The frame 16 secures a plurality of inline wheels 40 using a parallel axel system as is known in the art, and the particular system for mounting the wheels is not critical to the present invention. Mounted on the boot 12 is a flexible cuff 22 that supports the ankle and surrounds the boot 12, where the cuff 22 may have a fastening system 24 to tighten about the boot and provide additional support for the skater. The fastening system can be a strap 24 as shown, laces, hook and loop fasteners, or the like. The cuff 22 is fastened to the pivoting bracket 26, which in turn is secured to a shell 28 that links the cuff 22 to the frame 16. In an alternate embodiment, the bracket may be formed as part of the cuff 22 or the shell 28. The pivoting bracket 26 is secured so that it can pivot about a pin 30 that passes through the plate 26 and the cuff 22, permitting a rearward rocking of the cuff 22 by the skater. This rearward rocking motion causes a clockwise rotation of the bracket 26 about pin 30 as shown in FIG. 1. Conversely, a forward movement of the cuff 22 leads to a counterclockwise rotation of the bracket 26.

Figure 2:
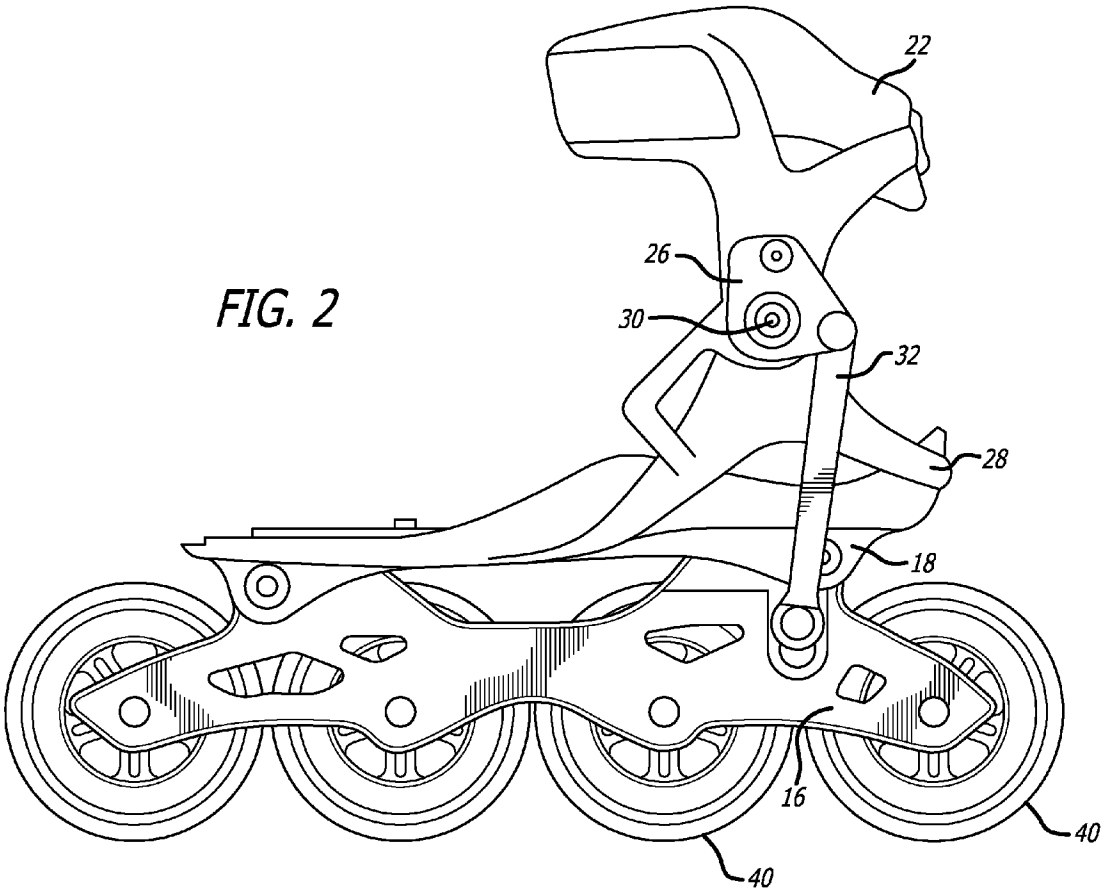
FIG. 2 is side view of the braking system of FIG. 1 with the boot removed.

FIG. 2 illustrates the skate braking system with the boot 12 removed for clarity. The cuff 22 is shown in the parked or neutral position, as would be expected when the skater is moving forward or standing freely on the skates with no braking force applied. The pivoting bracket 26 is shown with a push rod 32 mounted at the rearmost position, although the location of the coupling of the push rod 32 with the bracket 26 may be adjustable to account for different user's physiology and preferences. Such adjustment can be made using slots in the bracket instead of holes, where the push rod 32 is tightened in the preferred location. In a preferred configuration, the bracket is mounted so that the upper portion of the push rod 32 is slightly aft of the lower portion, creating an improved line of force for braking the skate.

The pushrods 32 coincide with the side of the skater's foot (as opposed to the back), depending almost vertically between the bracket 26 and the gap between the third and fourth wheels 40 when viewed from the side as seen in FIG. 2. An important consideration in the location of the pushrods 32 is that, because they are positioned directly above the location of applied braking force, they can transmit the most effective load, as opposed to behind the skater's heel which then transfers a lower percentage of the force.

Figure 3:
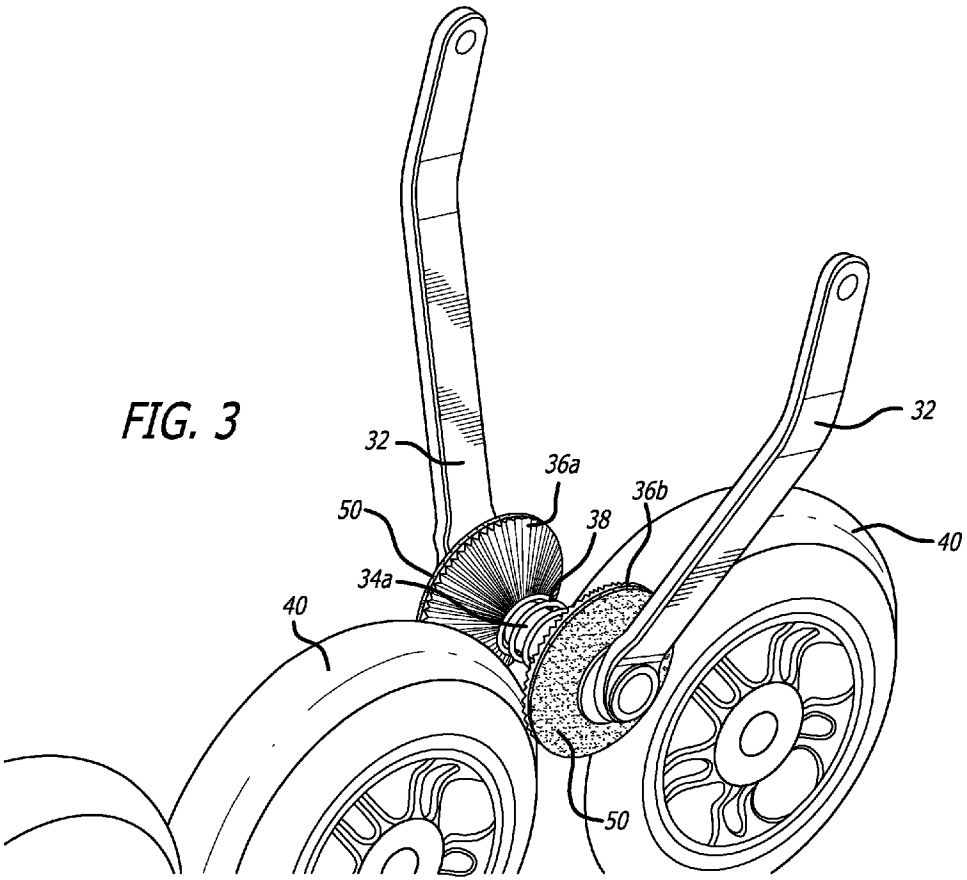
FIG. 3 is an enlarged, elevated perspective view of the wheels and braking elements.
Figure 4:
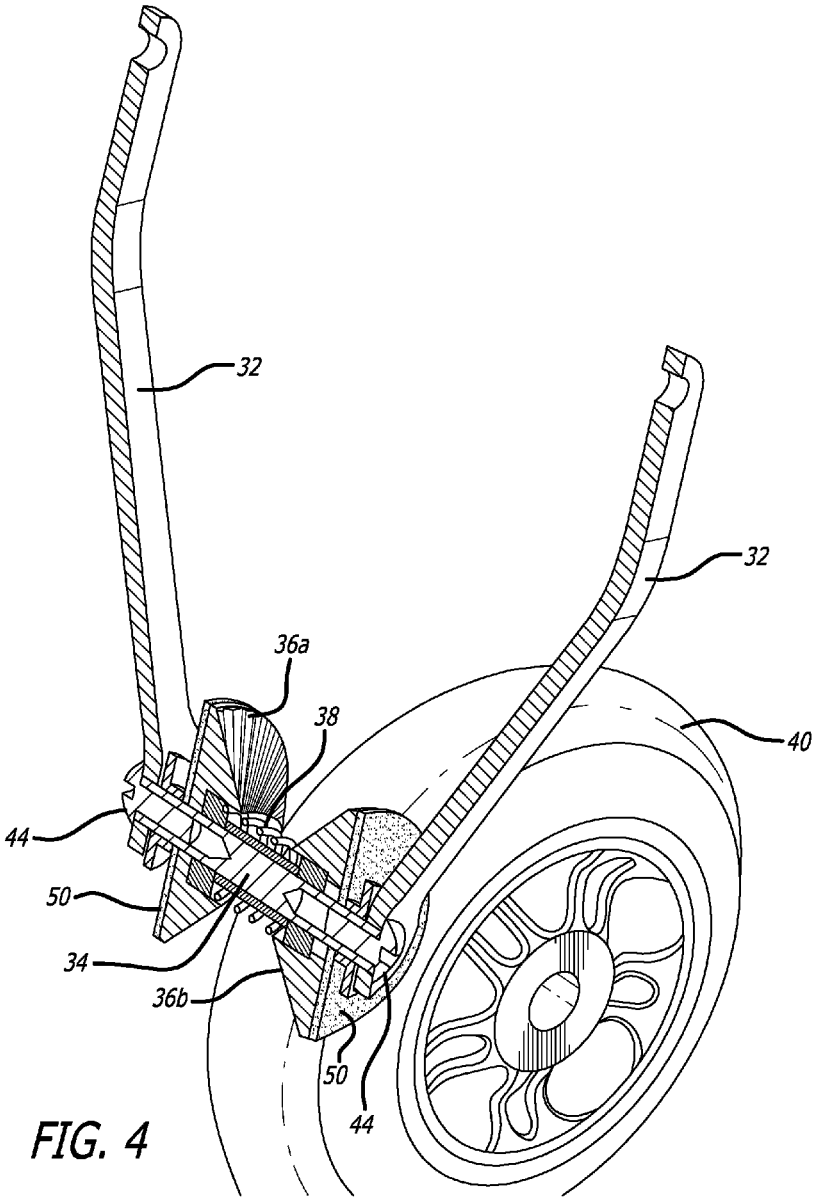
FIG. 4 is an enlarged, elevated perspective view partially in cross section of the braking system.

The lower end of the push rod 32 is connected to an axel 34, which may include a tubular bearing spacer 34*a* over the axel 34 (see FIGS. 3 and 4). The cylindrical axel 34 connecting the two pushrods 32 supports two freely rotating conical braking members 36*a*, 36*b*, which may be separated by a coiled spring 38. The spring 38 maintains the braking members in an optimal position above the adjacent wheels 40 on the frame 16 as shown in FIG. 3. The spring 38 may also prevent rattling or vibration of the braking members 36*a*, 36*b* when no downward pressure is applied by locating the braking members against on the extreme ends of the axel 34.

FIG. 4 illustrates the braking system in cross section, showing the pushrods 32 positioned over the gap between the penultimate and last wheels 40. The cylindrical axel 34 extends between the two pushrods at apertures 42 in the lower portion of the pushrod 32. The axel 34 may have hollowed ends that receive a locking pin 44 to retain the pushrods 32 on the axel 34, or another fastener type may be substituted such as a threaded arrangement. The axel 34 may also include the tubular bearing spacer 34*a* that keeps a pair of bearings 48 within the conical braking members 36*a*, 36*b* and in the proper position. The bearings 48 fit within the braking members 36*a*, 36*b* to promote free rotation about the axel 34.

The braking members 36*a*, 36*b* are preferably conical (or frustoconical) and cooperate to form a wedge therebetween that can contact and grip the wheels 40, further aided by serrations (see, e.g., FIG. 3) that extend radially along the braking member's conical surface. At the base of the conical braking members 36*a*,36*b* is a free rotating disk 50 that operates as a buffer between the braking members 36*a*, 36*b* and the inner surface 43 on the plates 16. This can be seen in particular in FIG. 6. The free disk 50 operates as a clutch to control the braking force applied by the skater in the following manner: The disks 50 are preferably made of a material similar to automobile brakes, and are both long lasting and easily replaceable. The theory is that the free disks are much easier and cheaper to replace than the wheels of the skate.

When the skater applies a downward force on the pushrods 32, causing the axel 34 to lower until the braking members 36*a*, 36*b* contact the spinning wheels 40 on their side surfaces, the braking members 36*a*, 36*b* initially spin with the wheels 40 to provide little braking force. As more downward pressure is applied, the braking members 36*a*, 36*b* are wedged outward by the wheels 40 on the axel 34, causing contact with the free disk 41. The free disk 41 in turn will rotate with the braking members 36*a*, 36*b* but also engage the inner surface of the plates 16 (see FIG. 8), providing a transition from a small amount of braking force to full braking force applied. In this manner, the free disks operate as a clutch or transition so that the skater can avoid the problem of having the wheels suddenly lock up when a braking force is applied, causing the skater to pitch forward uncontrollably and lead to possible injury. The braking elements 36*a,b* and the free disk 50 operate as a clutch system to prevent braking off the wheels, eliminating flattening out of the wheels which causes instability and leads to premature replacement. The diameter of the free disks 50 in a preferred embodiment is equal to, or just slightly greater than, the diameter of the base of the conical braking members 36*a,b*.

Figure 5:
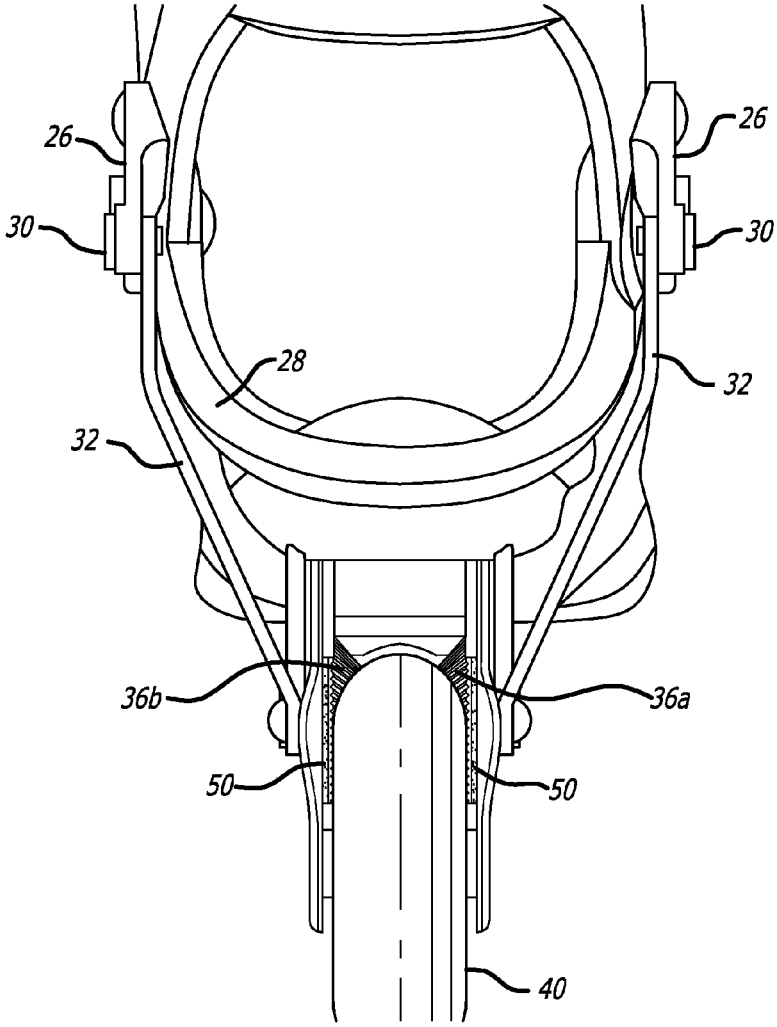
FIG. 5 is a rear view of the braking system of FIG. 1.

As shown in FIG. 5, the braking system is symmetric about a vertical plane that bisects the skate, and the braking members 36*a*, 36*b* are seated in the space between adjacent wheels (shown in the drawings as between the third and fourth wheels, but other combinations are also envisioned) when the cuff 22 is in the neutral position. The pushrods 32 include a first vertical portion 32*a* and a inwardly inclined portion 32*b* that engages the axel 34 at its respective distal ends. FIG. 5 illustrates how the plates 16 support the braking system, and serves as the substrate upon which the braking members (through the free disk 40) ultimate act upon.

Figure 6:
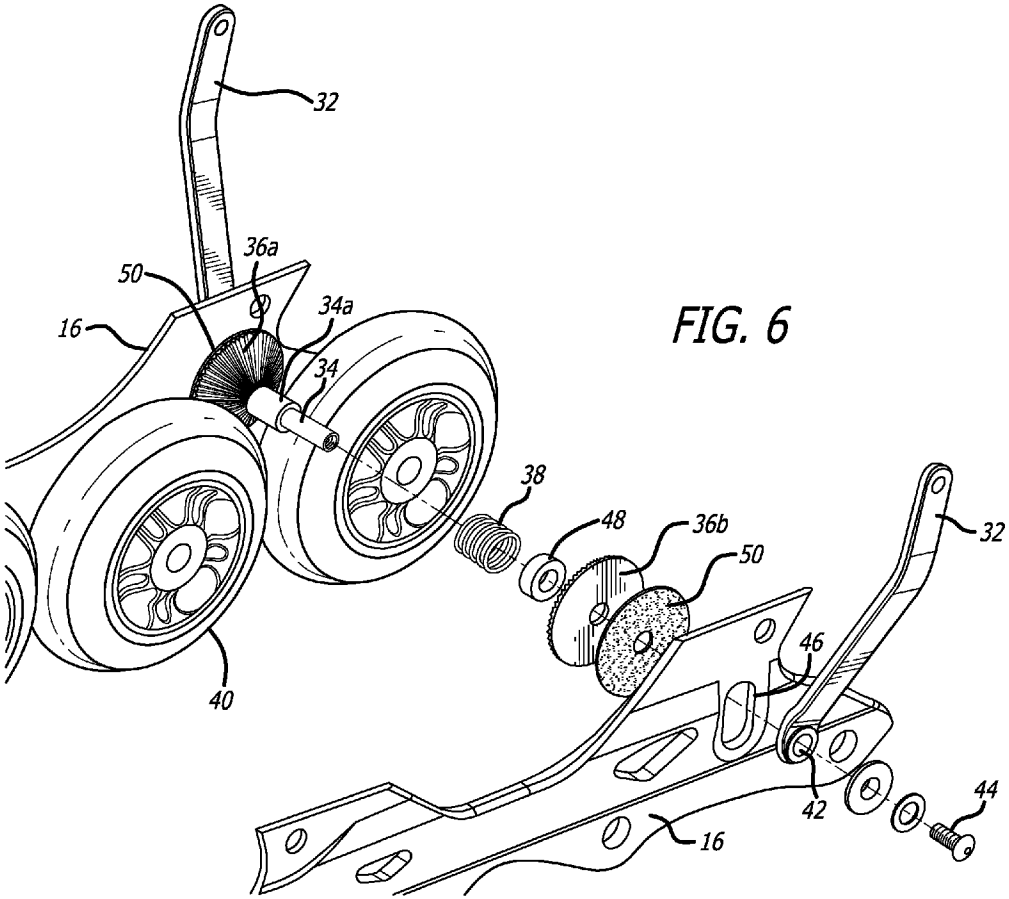
FIG. 6 is an exploded view of the braking system of FIG. 1.
Figure 7:
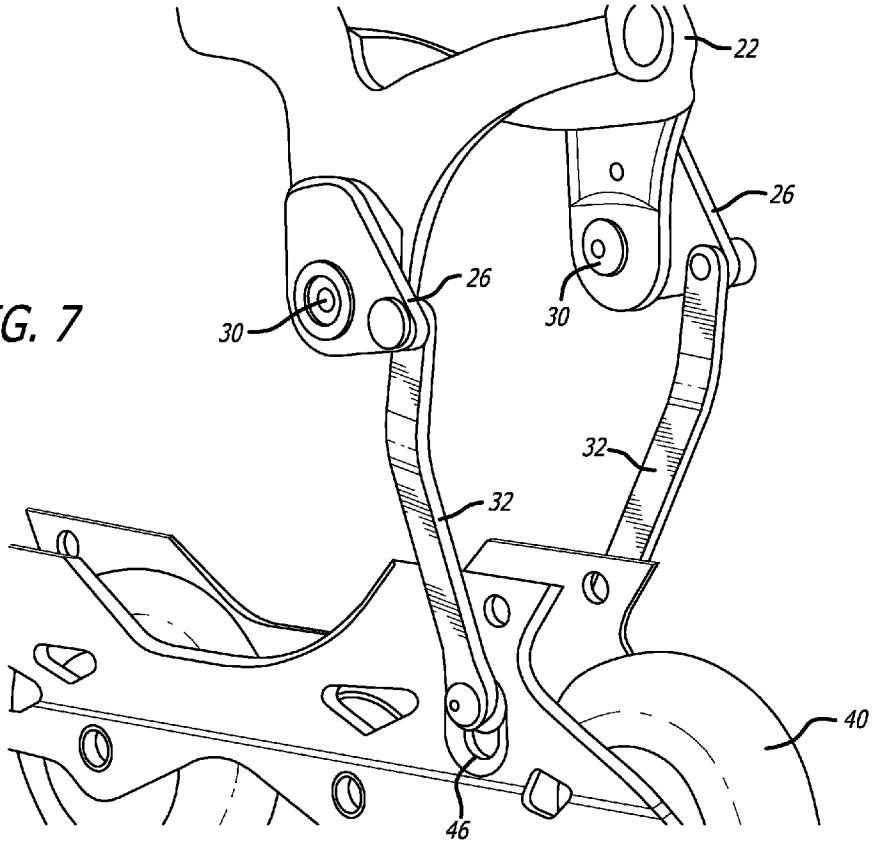
FIG. 7 is an enlarged, perspective view of the braking system of FIG. 1 with the skate boot removed.
Figure 8:
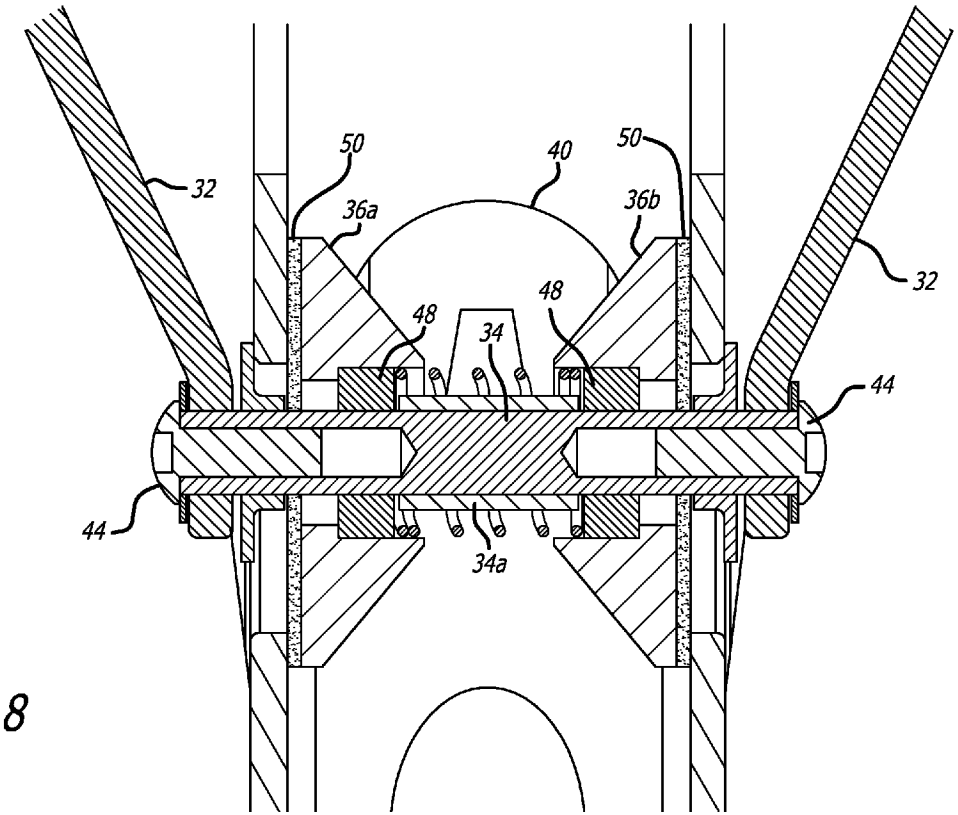
FIG. 8 is a cross sectional view of the axel and braking members of the braking system of FIG. 1.

FIGS. 6-8 illustrate the various elements of the braking assembly and their relationship to the pushrods 32, the axel 34, and braking members 36*a*, 36*b*. The push rods 32 have a hole 42 that receives a locking pin 44, which passes through the push rod 32, the vertical slot 46 in the frame 16, and through the conical braking member 36*b*, and into the axel 34. Ball bearings 48 can be mounted on the axel 34 to reduce friction between the conical braking members 36 and the axel 34. The bearing spacer 34*a* acts to keep the bearings inside the conical braking members 36*a*, 36*b*.

As shown in FIG. 7, the slot 46 in the frame 16 allows for vertical travel of the braking members 36*a*, 36*b* on the axel 34 with respect to the frame and thus, the wheel 40 position. That is, as the cuff 22 is rocked backward by the skater, the bracket 26 pivots about the pin 30, driving the push rods 32 downward and moving the axel 34 from the top of the slot 46 to the bottom of the slot 46. When the axel 34 is at the top of the slot 46, there is little or no engagement of the braking members 36*a*, 36*b* with the wheels 40 of the skate and the braking system is inactive. However, as the push rods 32 drive the axel 34 downward, the braking members 36*a*, 36*b* are brought into contact with the wheels 40 to retard the rotation of the wheels 40 and bring the skate to a gentle stop.

Figure 9:
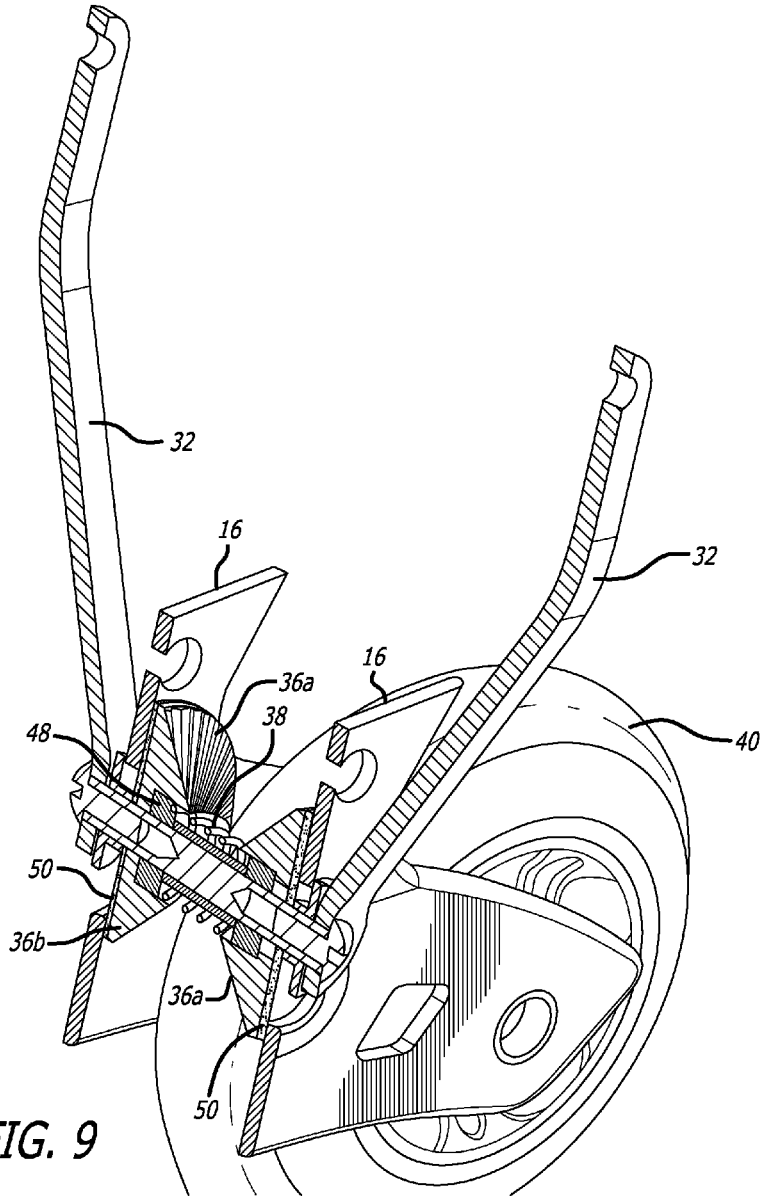
FIG. 9 is an elevated, enlarged perspective view partially in cross section of the braking system of FIG. 1.

FIG. 9 further illustrates the position of the wheel 40 and the braking members 36*a*, 36*b*. The braking members 36*a*, 36*b* are seating on the bearings 48, which ride on the axel 34. The braking members preferably have a surface with ridges that enhance the friction between the braking surface and the wheels. As the axel 34 is lowered and the braking members 36*a,b* engage the wheels 40, the brake members spin freely on the axel but the engagement of the braking members and the free disk 50 against the plate 16 is what stops the wheels. In this manner, there is less force applied to the wheels and thus less wear on the wheel surfaces, which are more expensive to replace than the free disks 50.

As stated above, one improvement of the just described system is the ability to apply full braking force to the brake pad and frame plates, as opposed to applying the braking force directly to the wheels. The wheels are the trigger in activating the braking power. The braking system prevents slippage of the braking pad on the wheels, and resists "lockup," that could otherwise cause flattening of that portion of the wheels touching the ground. To effect the braking system, the skater leans his/her leg forward to shift the boot 12 ahead of the cuff 22, rotating the pivoting bracket backwards. Braking is activated by a downward movement of the push rods, and the brake cones, against the side of the wheels of the skate. Additional downward force drives the cones outward against the free disks, which are sandwiched between the brake cones and the skate frame plates. The compression of the free disk between the braking members and the frame retards the rotation of the wheels to brake the skate.

The foregoing description and associated drawings are intended to be illustrative only, and not limiting in any manner. Rather, it is to be understood that various modifications and substitutions would be readily understood and appreciated by one of ordinary skill in the art, and the present invention is intended to cover all such modifications and substitutions. Accordingly, nothing in this specification should be interpreted as limiting the scope of the present invention.

We claim:

1. A braking assembly for an inline roller skate having a boot, an pair of mounting plates, and a plurality of inline wheels secured between the mounting plates, comprising:

a cuff mounted on the boot including a pair of pivoting brackets, the pair of pivoting brackets pivoting relative to the cuff;

a pair of push rods coupled to the pair of pivoting brackets at a first end, and connected at a second end by an axel extending therebetween, where the push rods have an upper portion oriented substantially vertically and parallel, a middle portion oriented inwardly converging to the axel therebetween, and a lower portion that is substantially vertical and parallel, where the boot is disposed between the pair of push rods at the upper portion, and wherein the pair of pivoting brackets are disposed fore of a last inline wheel, the axel reciprocates vertically within a slot in the mounting plates;

a pair of conical braking elements disposed on the axel and opposed to each other, the conical braking elements including serrations radially aligned on an outer surface for engaging at least one of said wheels;

a spring disposed between the braking elements to maintain a gap between the braking elements; and a pair of freely rotating disks each disposed on the axel between a respective planar surface of a conical braking element and an inner surface of a respective mounting plate, the free disk moderating an applied frictional load between the conical braking element and the mounting plate;

wherein the location of the upper portion of the push rod's connection to the pair of pivoting brackets is adjustable.

2. The braking assembly of claim 1, further comprising a bearing disposed within each conical braking element and mounted on the axel.

3. The braking assembly of claim 1, wherein the braking element is positioned to engage two wheels of the plurality of inline wheels.

4. The braking assembly of claim 3, where the two wheels occupy the third and fourth positions among the plurality of inline wheels.

5. The braking assembly of claim 1 further comprising a bearing spacer tube positioned on the axel between the pair of conical braking elements to separate a pair of bearings thereon.

6. The braking assembly of claim 1 wherein the engagement of the braking elements with the wheels is adapted to prevent slip between contacting surfaces of the wheels and braking element.

7. The braking assembly of claim 1 wherein a diameter of the freely rotating disks is equal to a diameter of the conical braking elements.

8. The braking assembly of claim 1 wherein the spring between the braking elements prevents rattling of the braking elements on the axel.

9. The braking assembly of claim 1, wherein a slot in the mounting plates is selected to allow conical braking elements to adjustably make contact between adjacent wheels.

10. The braking assembly of claim 1 wherein an upper portion of the push rods are aft of the lower portion in a parked position.

* * * * *